United States Patent [19]

Franckowiak et al.

[11] Patent Number: 4,598,892

[45] Date of Patent: Jul. 8, 1986

[54] MECHANICAL CHAIR-HEIGHT CONTROL MECHANISM

[75] Inventors: Paul F. Franckowiak, Grand Haven; Walter C. Mrotz, III, Comstock Park, both of Mich.

[73] Assignee: Haworth, Inc., Holland, Mich.

[21] Appl. No.: 634,944

[22] Filed: Jul. 27, 1984

[51] Int. Cl.[4] ..... F16M 11/24; A61G 15/00

[52] U.S. Cl. ..... 248/406.2; 248/188.7; 297/348

[58] Field of Search ..... 248/406.2, 188.7, 188.4, 248/406.1; 297/348, 345

[56] References Cited

U.S. PATENT DOCUMENTS

| | | | |
|---|---|---|---|
| 3,160,382 | 12/1964 | Lee | 248/188.7 |
| 3,218,021 | 11/1965 | Michalshi . | |
| 3,667,716 | 6/1972 | Fries | 248/188.4 |
| 3,705,704 | 12/1972 | Textoris | 248/188.7 |
| 3,799,486 | 3/1974 | Mohr et al. . | |
| 3,870,271 | 3/1975 | Bowman | 248/406.2 |
| 3,991,965 | 11/1976 | Westover et al. | 248/406.2 |
| 4,026,509 | 5/1977 | Wolters . | |
| 4,262,871 | 4/1981 | Kolk et al. | 248/188.7 |
| 4,324,382 | 4/1982 | Beukema et al. | 248/406.2 |
| 4,394,001 | 7/1983 | Wisniewski . | |
| 4,494,721 | 1/1985 | Trinkel et al. | 248/406.2 |

*Primary Examiner*—Ramon S. Britts
*Assistant Examiner*—Karen J. Chotkowski
*Attorney, Agent, or Firm*—Flynn, Thiel, Boutell & Tanis

[57] ABSTRACT

A chair having a threaded spindle connected to the chair seat and projecting downwardly therefrom and being rotatably supported within the pedestal of a base. A load-released height-adjusting mechanism coacts between the pedestal and the spindle and includes a nut threadably mounted on the spindle and spring-urged upwardly for clutchable engagement with a clutch member which is nonrotatably and axially secured relative to the pedestal. The clutch member includes not only a top clutch plate positioned for engagement with the nut, but also an axially elongated sleeve portion which projects downwardly in surrounding relationship to the nut and is stationarily coupled to the pedestal by means of a bayonet-type coupling. The sleeve portion of the clutch member has a resilient locking finger which cooperates with the bayonet coupling for preventing relative rotation of the clutch member relative to the base after they have been coupled together.

6 Claims, 9 Drawing Figures

MECHANICAL CHAIR-HEIGHT CONTROL MECHANISM

FIELD OF THE INVENTION

This invention relates to a spindle-type support for a chair of the swivel or pivotal type and, in particular, to an improved load-released height-adjusting mechanism associated with the support.

BACKGROUND OF THE INVENTION

Height-adjusting mechanisms of the aforesaid type, wherein the height of the chair seat is adjusted by rotation of the chair seat when unoccupied, with the adjusting mechanism being disengaged when the chair seat is occupied, are well known and such mechanisms are now being widely used on spindle-type office chairs. In mechanisms of this general type, the spindle is threadably engaged with a nut which can be suitably held in nonrotatable relationship relative to either the base or the chair seat so as to define adjusting and nonadjusting positions. A spring normally urges the chair seat slightly upwardly when it is unoccupied so that the nut is nonrotatably connected to the base, whereby rotation of the seat causes the spindle to threadably move through the nut and hence cause a height adjustment of the seat. Conversely, when the chair seat is occupied, the external force imposed on the chair seat overcomes the spring and moves the chair seat and spindle downwardly a limited amount so that the nut is nonrotatably engaged with the spindle, whereby swivelling or rotating the occupied chair seat does not change its height.

Examples of known height-adjusting mechanisms which are generally of the above type are disclosed by U.S. Pat. Nos. 3,870,271 and 3,991,965.

U.S. Pat. No. 4,394,001, as owned by the assignee of this application, also discloses a height-adjusting mechanism of this type. While the height-adjusting mechanism of this latter patent operates in a desirable manner, nevertheless ongoing improvements in the chair and specifically in the base assembly for the chair have also resulted in improvements with respect to the height-adjusting mechanism.

More specifically, this invention relates to a height-adjusting mechanism of the type disclosed by said U.S. Pat. No. 4,394,001 but relates to improvements with respect to the structure associated with said mechanism so as to facilitate the assembly and durability of the mechanism. The improved mechanism of this invention employs a stationary clutch member formed substantially as an elongated sleevelike housing which can be stationarily secured with respect to the pedestal by an assembly technique whereby the stationary clutch member is both axially and rotatably displaced so as to lockingly join the clutch member to the pedestal without requiring separate fasteners, whereby the assembly can hence be efficiently and easily accomplished.

Other objects and purposes of the invention will be apparent to persons familiar with mechanisms of this general type upon reading the following specification and inspecting the accompanying drawings.

Figure 1:
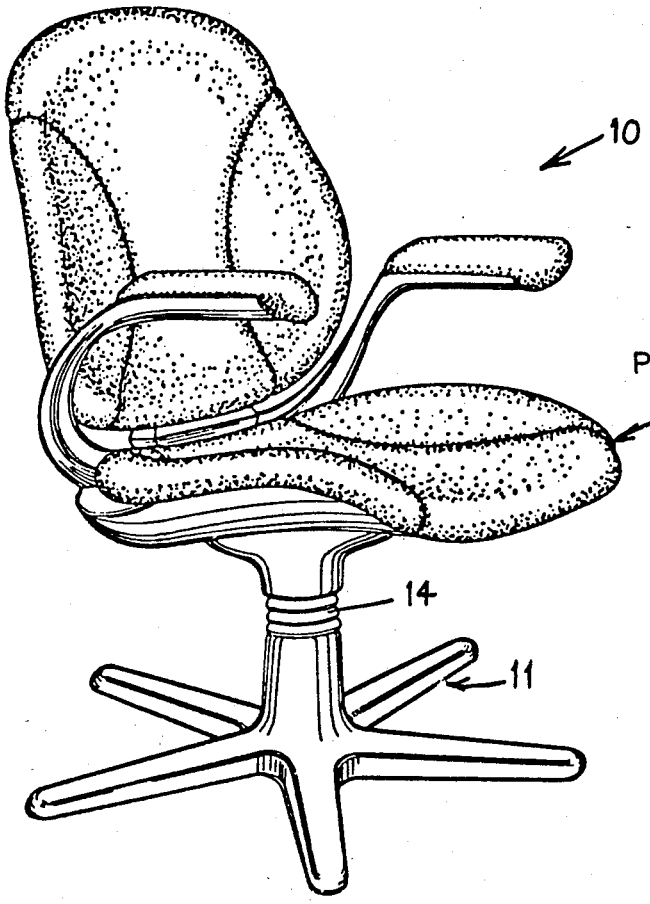
FIG. 1 PRIOR ART
FIG. 1 is a perspective view of a swivel-type chair employing therein the height-adjusting mechanism of this invention.

Certain terminology will be used in the following description for convenience in reference only and will not be limiting. For example, the words "upwardly", "downwardly", "rightwardly" and "leftwardly" will refer to directions in the drawings to which reference is made. The words "upwardly" and "downwardly" will also refer to the direction of movement of the chair seat responsive to the height-adjustment thereof. The words "inwardly" and "outwardly" will refer to directions toward and away from, respectively, the geometric center of the chair and designated parts thereof. Said terminology will include the words specifically mentioned, derivatives thereof, and words of similar import.

DETAILED DESCRIPTION

Referring to FIG. 1, there is illustrated a swivel-type chair 10 having a pedestal-type base assembly for swivelably supporting a seat assembly 12. The base and seat assemblies are joined together by a height-adjusting mechanism 13 (FIG. 2), which mechanism is similar to the mechanism of aforementioned U.S. Pat. No. 4,394,001. An elongated flexible bellows 14, which has the upper and lower ends thereof connected to the seat and base assemblies, respectively, encloses the height-adjusting mechanism.

The base assembly 11 preferably includes a one-piece base member 16 which has a one-piece plastics base cover 17 telescopically positioned thereover. The base member includes a central sleevelike hub 18, which hub as a part thereof includes an upwardly projecting support tube 19 which defines a central opening 21 projecting vertically therethrough. The support tube 19 mounts within the opening thereof a sleevelike liner 22 of a suitable plastics material so as to function substantially as a bearing sleeve. The base member 16 also has a plurality, preferably five, of elongated leg members 23 which are fixed to the hub 18 and project radially therefrom in uniformly angularly spaced relationship therearound. The one-piece plastic cover 17 also includes a substantially cylindrical sleevelike central hub portion 26 which is positioned in surrounding relationship to the base hub 18, and is provided with a plurality of leg cover portions 27 projecting radially therefrom. The leg covers 27 have a downwardly opening channel-shaped cross section so as to be individually and respectively positioned over the base leg members 23.

Considering now the height-adjusting mechanism 13, same includes an elongated upright support shaft or spindle 31 which has its upper end nonrotatably fixed to the seat assembly 12, such as by being fixed to the frame elements 32 associated with a chair control as conventionally provided within the seat assembly. The spindle 31 projects downwardly from the seat assembly and extends through the hub or pedestal of the base, specifically through the opening 21 whereby the spindle is rotatably supported within the liner 22. The spindle has an externally threaded portion 33 extending over a substantial extent thereof.

Figures 2, 3:
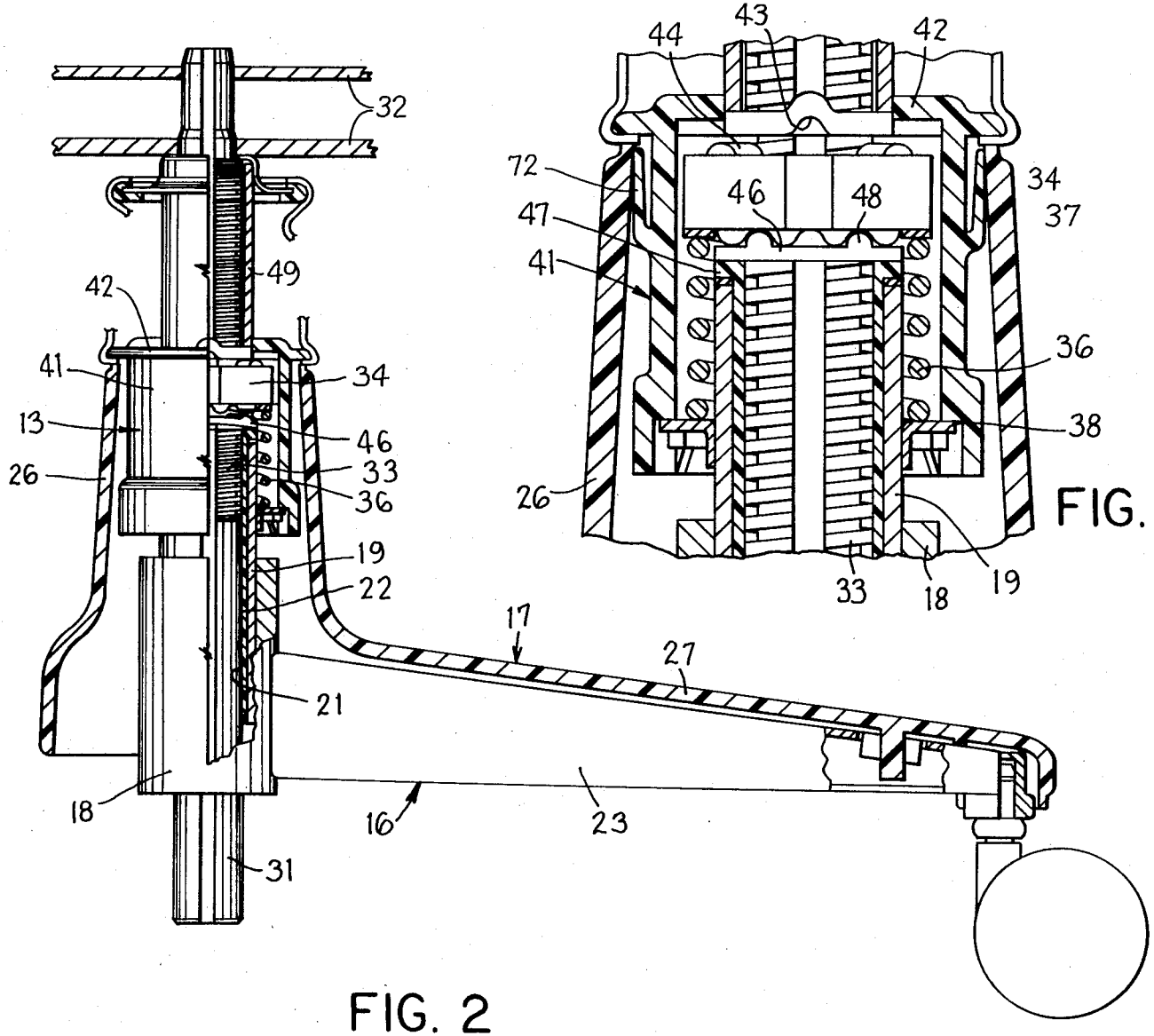
FIG. 2 is a fragmentary elevational view, partially in cross section, illustrating the spindle assembly, including the height-adjusting mechanism.
FIG. 3 is an enlarged, fragmentary, sectional view illustrating the height-adjusting mechanism in its disengaged position.
Figure 5:
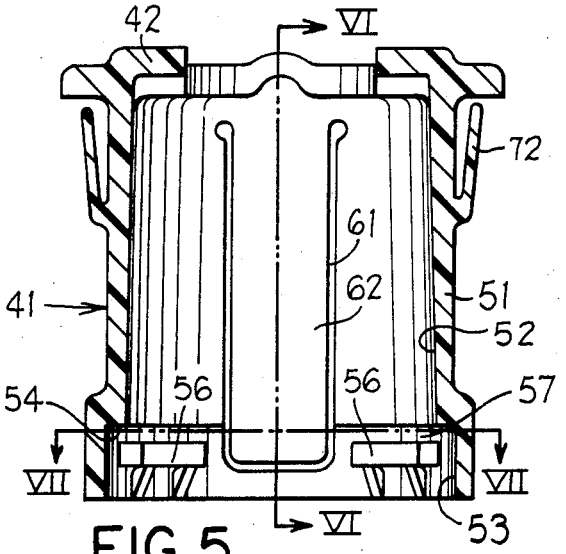
FIG. 5 is a central sectional view of the nonrotatable clutch member as taken substantially along the line V—V in FIG. 4.
Figure 6:
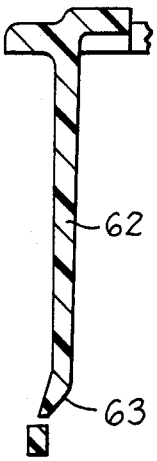
FIG. 6 is a fragmentary sectional view as taken substantially along the line VI—VI in FIG. 5.
Figure 4:
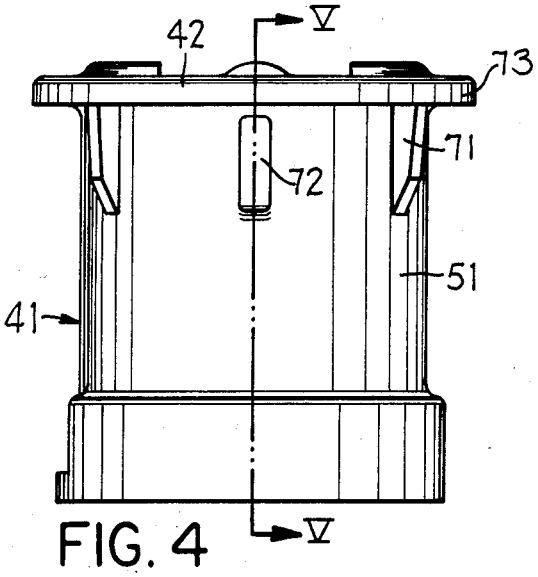
FIG. 4 is an elevational view of the nonrotatable clutch member.

As shown in FIGS. 2 and 3, the height-adjusting mechanism 13 includes a rotatable clutch member or nut 34 which is threadably engaged with the threaded portion 33 of the spindle 31. This nut 34 is positioned within the upper end of the cover hub 26 above the base hub 18. A spring 36, such as a coil-type compression spring, concentrically surrounds the support tube 19 and has the upper end thereof disposed in bearing engagement with an annular washer 37, which in turn bears against the underside of the nut 34. The lower end of spring 36 is seated on an annular cam plate 38 which surrounds and is stationarily secured to the support tube 19. The spring 36 hence continuously urges the nut 34 upwardly for engagement with a stationary clutch part 41, the latter being fixedly secured to the upper end of the base pedestal as described hereinafter.

This stationary clutch part 41 includes a top annular clutch plate 42 which concentrically surrounds the spindle and projects radially outwardly a sufficient extent so as to effectively bear or seat against the exposed upper end of the cover hub 26. This top clutch plate 42 has several, here four, cam recesses or grooves 43 formed therein in equally angularly spaced relationship. These recesses 43 have a rounded configuration when viewed in cross section. The upper axial end of nut 34 has several, here four, cams or ridges 44 formed thereon and projecting axially upwardly therefrom, which cams 44 have a rounded configuration and are adapted to project into and closely occupy the grooves or recesses 43 formed in the top clutch plate. When the cams 44 are engaged within the recesses 43, the nut 34 is nonrotatably connected to the stationary clutch part 41, and hence is nonrotatably held relative to the base member 16.

Positioned below the nut 34 is a clutch-type annular bearing washer 46 which is nonrotatably coupled to but axially slidable relative to the spindle 31. This clutch washer 46 has a radially inwardly projecting tab (not shown) which is slidably engaged within an axially elongated keyway (not shown) formed in the spindle 31, such as is conventional, so as to nonrotatably connect the clutch washer to the spindle but permit the spindle to axially move relative thereto. This clutch washer 46 is rotatably seated on an annular bearing flange 47 which in the preferred embodiment is integral with the liner 22, which flange 47 seats on the exposed upper end of the support tube 19. The clutch washer 46 has several, here four, clutch projections 48 provided thereon and spaced equally angularly therearound. These clutch projections 48 project axially upwardly from the upper surface of the washer, and are designed to project into similar rounded recesses as formed in the lower axial end surface of the nut 34.

As illustrated by FIG. 3, the stationary clutch plate 42 and the clutch washer 46 are disposed on opposite axial sides of the nut 34 and are axially spaced apart by a distance which exceeds the axial dimension of the nut. Hence, spring 36 normally urges the nut 34 and the associated spindle 31 and seat assembly 12 upwardly so that the nut is nonrotatably clutched to the clutch plate 42. When the seat assembly 12 and spindle 31 are moved downwardly against the urging of spring 36, the nut 34 disengages the stationary clutch plate 42 and moves downwardly for engagement with the clutch washer 46, which prevents any further downward movement of the seat assembly and nonrotatably couples the nut 34 to the spindle 31 so that it rotates therewith as a unit. This latter position is assumed when the chair seat is occupied.

The height-adjusting mechanism 13 also preferably includes an elongated rigid sleeve or tube 49 of preselected length, which tube is disposed in surrounding relationship to the spindle 31 and is positioned axially between the nut 34 and the underside of the chair seat. This tube 49 reacts directly against the nut 34 to prevent further relative rotation between the spindle and nut when the seat assembly is adjustably moved into its lowermost height position.

The structural and functional relationships of the height adjusting mechanism, as hereinabove described, are explained in greater detail in aforesaid U.S. Pat. No. 4,394,001.

Considering now the stationary clutch part 41 (FIGS. 3–8), same includes an axially elongated sleeve part 51 which is integrally fixed to and projects downwardly from the top clutch plate 42. This sleeve part 51 has a substantially uniform inner diameter 52 extending over a major portion of the axial length thereof. However, adjacent the open lower free end of the sleeve part, there is provided an enlarged bore 53 having an inner diameter which slightly exceeds that of the bore 52, which larger bore 53 projects axially upwardly from the lower free end through a limited axial extent and terminates in an annular shoulder 54. The sleeve part 51 also has plural, here four, lock or stop flanges 56 fixed thereto and projecting radially inwardly from the wall of the bore 53. These lock or stop flanges 56 each extend through a substantial arcuate extent, and the flanges are uniformly angularly spaced apart so as to define open regions extending angularly between adjacent flanges, which open regions have an angular extent approximately equal to that of the flanges. These stop flanges 56 are spaced axially downwardly a small axial extent from the shoulder 54 so as to define a narrow circumferentially extending groove 57 therebetween. The stop flanges 56 have radially inner edges which effectively define a diameter substantially equal to that of the bore 52.

The sleeve part 51 also has a substantially U-shaped slit 61 formed in the sidewall thereof, which slit results in the formation of an elongated cantilevered resilient locking finger 62. This locking finger is integrally joined to the sleeve part adjacent its upper end, with the locking finger projecting axially downwardly in a cantilevered fashion. The locking finger is substantially aligned with the open region between a pair of said stop flanges 56, and in fact the lower free end of this resilient locking finger 62 projects downwardly past the shoulder 54 and terminates substantially between a pair of said locking flanges 56. The lower free end of this locking finger 62, on the inner surface thereof, is provided with a cam surface 63 which slopes inwardly and upwardly.

The sleeve part 51 of the stationary clutch member 41 is designed to create a locking engagement with the annular cam plate 38 as secured to the support tube 19. For this purpose, this annular cam plate 38 has a plurality, here four, of platelike locking cams 66 projecting radially outwardly therefrom in substantially uniformly angularly spaced relationship therearound. Each of these locking cams 66 comprises a radially outwardly projecting part which is arcuately elongated, with the adjacent locking cams 66 being circumferentially separated by arcuate recesses 67. These locking cams 66 effectively define an outer diameter which is greater than the diameter of the bore 52 but less than the diameter of the bore 53. These locking cams 66 also have an arcuate extent which is slightly less than the arcuate extent of the recesses formed between the adjacent stop flanges 56 on the sleeve part 51.

Figures 7A, 7B:
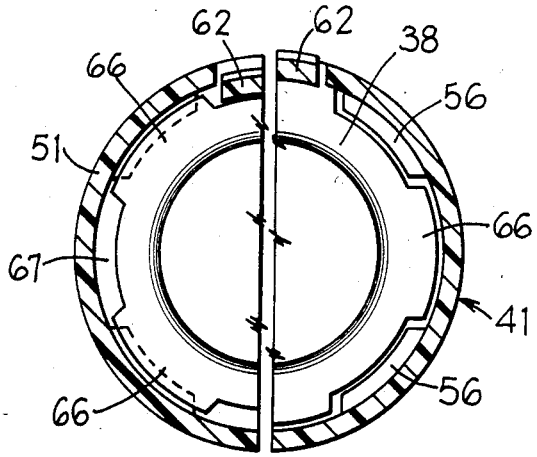
FIGS. 7A and 7B are taken substantially along the line VII—VII in FIG. 5 and illustrate the nonrotatable clutch member in the assembly position and the locked position, respectively, with respect to the base pedestal.
Figure 8:
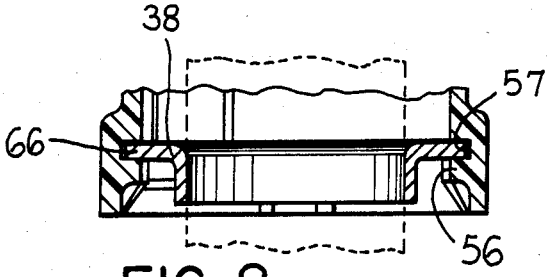
FIG. 8 is a fragmentary sectional view illustrating the manner in which the nonrotatable clutch member is lockingly coupled to the base pedestal, in correspondence with the position illustrated by FIG. 7B.

To secure the stationary clutch member 41 with respect to the base assembly, the stationary clutch part 41 is disposed in surrounding relationship to the spindle in upwardly spaced relationship from the base assembly. The stationary clutch member 41 is then moved axially downwardly relative to the base assembly so as to cause the sleeve part 51 to telescopically move inside the cover hub 26, which in turn results in the sleeve part 51 being disposed so as to telescopically surround the support tube 19. The clutch member 41 is initially rotatably positioned with respect to the spindle such that the stop flanges 56 are aligned with the recesses 67 formed in the cam plate 38. Hence, the clutch member 41 is then telescopically moved axially downwardly until the stop flanges 56 pass through the recesses 67 such that the annular shoulder 54 abuts against the upper surfaces of the locking cams 66. As the stop flanges 56 are passing axially downwardly through the recesses 67, the cam surface 63 associated with the lower free end of the locking finger 62 engages the radially outer edge of one of the locking cams 66 and causes the locking finger 62 to be resiliently deflected outwardly substantially as illustrated by FIG. 7A. When the annular shoulder 54 is seated against the upper surfaces of the locking cams 66, in which position the outer rim portion of the top clutch plate 42 effectively overlies the upper free end of the cover hub, then the clutch member 41 is rotated relative to the base through an angle of approximately 45° in either direction. This rotation causes the stop flanges 56 to move into a position directly beneath the locking cams 66, which cams are hence confined in the narrow grooves 57 whereby the support tube 19 and clutch member 41 are hence axially locked together. The abovedescribed structure hence defines a bayonet-type coupling for axially connecting the clutch member to the base pedestal.

As the clutch member 41 is being rotated into this locked position, the free end of the spring finger 62 slides along the outer surface of the locking cam 66 until reaching the end of the locking cam, in which position the lower free end of the locking finger 62 is substantially aligned with and hence snaps into the adjacent recess 67, substantially as illustrated by FIG. 7B. With the locking finger 62 positioned within one of the recesses 67, this hence prevents the clutch member 41 from being rotated in either direction into a release position, and hence positively maintains the clutch member 41 both axially and rotatably locked with respect to the base.

The clutch member 41 also preferably has a plurality of centering ribs 71 which are fixed to and project radially outwardly from the sleeve part 51 and project upwardly for integral connection with the rim portion 73 of the top cam plate 42. These ribs 71 assist in slidably guiding the clutch part 41 into the open upper end of the cover hub 26, and assist in maintaining the sleeve part 51 properly centered and held within the cover hub 26. In addition to the ribs 71, the sleeve part 51 also has a plurality of resilient spring fingers 72 integrally formed thereon and projecting outwardly and upwardly therefrom in a cantilevered fashion. These spring fingers 72 are angularly spaced between the ribs 71, and project upwardly so that the free ends thereof are disposed adjacent the underside of the rim 73. These spring fingers 72 also engage and are resiliently deflected inwardly by the inner surface of the cover hub 26 to assist in creating a resilient frictional engagement with the cover hub so as to maintain a desired concentric and stationary relationship of the clutch member relative to the cover hub.

The stationary clutch member 41 is preferably integrally formed in one piece, as by being molded of a suitable plastics material. This hence permits formation of the clutch member having multiple structural and functional relationships in a simple and economical manner, and hence provides a clutch member which permits assembly and maintenance to be accomplished both efficiently and economically.

To remove the clutch member 41, a long bladed tool such as a screwdriver is inserted from below to base to deflect the spring finger 62 outwardly, whereupon the member 41 can be rotated into an unlocked position and then axially removed.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a chair having a seat means, a base assembly having an upwardly projecting pedestal defining a central opening which projects vertically downwardly thereof, a vertically elongated spindle which is at least partially externally threaded and has the upper end portion thereof nonrotatably connected to said seat means, the lower portion of said spindle being rotatably supported within the central opening of said pedestal, and a load-released height-adjusting mechanism coacting between said spindle and said pedestal for permitting the seat means and spindle to be vertically displaced a preselected distance between a raised position when the seat means is unoccupied and a lowered position when the seat means is occupied, said height-adjusting mechanism permitting free rotation of the seat means when the latter is occupied and is in said lowered position, said height-adjusting mechanism permitting the height of said seat means to be vertically adjusted relative to the pedestal when the seat means is in said raised position and the unoccupied seat means is rotated relative to the pedestal, said height-adjusting mechanism including a nut threadably engaged with said spindle and sprinig-urged upwardly toward said raised position, said height-adjusting mechanism also including a clutch means for nonrotatably connecting the nut to the pedestal when in said raised position, the nut being disengaged from the clutch means when in said lowered position, the improvement wherein said clutch means comprises a one-piece clutch member having an annular clutch plate positioned above said nut in surrounding relationship to said spindle, said clutch means also including a sleevelike part which is concentrically fixed to said clutch plate and projects axially downwardly therefrom in surrounding relationship to said spindle, said sleevelike part concentrically surrounding said nut and projecting axially downwardly therefrom in concentric surrounding relationship to the upper end of said pedestal, and coupling means coacting between said sleevelike part and said pedestal for defining a bayonet-type connection therebetween for stationarily coupling said clutch member to said pedestal, said bayonet-type coupling means including a first plurality of locking flanges which are fixed to and project radially outwardly from said pedestal in circumferentially spaced relationship therearound so as to define recesses between circumferentially adjacent locking flanges, said coupling means also including a plurality of circumferentially spaced, radially inwardly projecting locking tabs formed on said sleevelike part adjacent the lower free end thereof, said locking tabs being angularly spaced apart by intermediate spaces, said sleevelike part also having annular shoulder means formed internally thereof and directed axially downwardly, said shoulder means being spaced directly axially above said locking tabs for defining a narrow groove therebetween in which to accommodate said locking flanges.

2. A chair according to claim 1, wherein said clutch member includes an elongated resilient locking finger integrally joined to said sleeve part and being resiliently snapped into one of said recesses to prevent relative rotation between the locking tabs and locking flanges when said locking tabs are disposed directly axially below the locking flanges.

3. A chair according to claim 2, wherein said clutch member is integrally formed in one piece of a plastics material.

4. A chair according to claim 2, wherein said base assembly includes a base member having said pedestal formed as a part thereof, said base member also having a plurality of legs fixed to said pedestal and projecting radially therefrom, said base assembly also including a base cover for at least partially enclosing said base member, said base cover including a central hub portion which substantially concentrically surrounds and is spaced radially outwardly from said pedestal, said hub portion projecting upwardly a substantial extent beyond the upper end of said pedestal, and said clutch member having an annular flange portion at the upper end thereof and projecting radially outwardly of said sleevelike part, said flange portion being positioned so as to radially overlap and substantially axially abut the upper end of said hub portion.

5. A chair according to claim 4, including resilient means mounted on said sleevelike part adjacent the upper end thereof and creating a resilient frictional engagement with the inner wall of said hub portion for frictionally holding said clutch member within said hub portion.

6. A chair according to claim 1, wherein said coupling means includes an annular cam plate which externally surrounds and is fixedly secured to said pedestal at a location spaced downwardly from the upper free end thereof, said cam plate projecting radially outwardly from said pedestal, said spring meeans comprising a coil spring which has the lower end thereof seated on said cam plate with said spring means projecting upwardly in surrounding relationship to said pedestal for engagement with the underside of said nut, said cam plate also having said locking flanges formed thereon and projecting radially outwardly thereof.

* * * * *